US006662795B2

(12) United States Patent
Baldwin et al.

(10) Patent No.: US 6,662,795 B2
(45) Date of Patent: Dec. 16, 2003

(54) METHOD AND APPARATUS CONFIGURED TO MAINTAIN A DESIRED ENGINE EMISSIONS LEVEL

(75) Inventors: Darryl D. Baldwin, Lacon, IL (US); Sean R. Strubhar, East Peoria, IL (US); Choy Yap, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/933,544

(22) Filed: Aug. 20, 2001

(65) Prior Publication Data

US 2003/0034018 A1 Feb. 20, 2003

(51) Int. Cl.[7] ..... F02D 41/00
(52) U.S. Cl. ..... 123/676; 123/677
(58) Field of Search ..... 123/676, 677, 123/678, 679, 681, 682, 687, 689; 701/104, 109

(56) References Cited

U.S. PATENT DOCUMENTS 4,612,770 A * 9/1986 Tadokoro et al. ..... 60/602
4,922,429 A * 5/1990 Nakajima et al. ..... 701/109
5,035,219 A * 7/1991 Ohkumo et al. ..... 123/406.33
5,239,965 A * 8/1993 Ninomiya ..... 123/492
5,284,116 A * 2/1994 Richeson, Jr. ..... 123/406.2
5,544,639 A * 8/1996 Shouda et al. ..... 123/676
5,579,746 A * 12/1996 Hamburg et al. ..... 123/689
5,703,777 A * 12/1997 Buchhop et al. ..... 701/109
5,735,245 A 4/1998 Kubesh et al.
5,899,192 A * 5/1999 Tsutsumi et al. ..... 123/492
6,062,204 A * 5/2000 Cullen ..... 123/568.22
6,148,808 A * 11/2000 Kainz ..... 123/673
6,161,531 A * 12/2000 Hamburg et al. ..... 123/674
6,233,927 B1 * 5/2001 Hirota et al. ..... 60/297
6,302,091 B1 * 10/2001 Iida ..... 123/685
6,378,515 B1 * 4/2002 Geyer ..... 123/683
6,408,686 B1 * 6/2002 Tallio et al. ..... 73/118.1

FOREIGN PATENT DOCUMENTS

JP 58185 * 3/1994 ..... F02D/41/10

* cited by examiner

*Primary Examiner*—Hieu T. Vo
*Assistant Examiner*—Hai Huynh
(74) *Attorney, Agent, or Firm*—W. Bryan McPherson, III; Clifton G Green

(57) ABSTRACT

The present invention is configured to maintain a desired emissions level of an engine having an intake manifold and an exhaust manifold, and an exhaust stack is disclosed. The method includes the steps of establishing a desired emissions level, establishing an engine speed, establishing an engine load, establishing at least one characteristic of one of an intake air and an exhaust gas, and determining a fuel command in response to the engine speed, the engine load, and the desired emissions level, the fuel command resulting in the engine maintaining the desired emissions level.

35 Claims, 7 Drawing Sheets

METHOD AND APPARATUS CONFIGURED TO MAINTAIN A DESIRED ENGINE EMISSIONS LEVEL

TECHNICAL FIELD

This invention relates generally to a method and apparatus of controlling an engine, and more particularly, to an apparatus and method configured to maintain a desired emissions level of an engine.

BACKGROUND

Engine emissions, such as NOx emissions, play an important role in engine control. In some applications, emitting higher than desired NOx levels, while still within regulatory standards, may cause problems in the particular application the engine is being used. For example, in a greenhouse a low level of NOx is desirably maintained at an even level. However, current control systems are unable to do this. If the engine emissions are higher than a designated amount, then the emissions adversely effect the greenhouse. On the other hand, if the engine emissions are below the designated amount, then overall engine performance may suffer. That is, engine efficiency decreases as NOx emissions levels decrease. Therefore running the engine in an operating range where lower NOx levels are being emitted than necessary to meet site or regulatory emissions restrictions, causes a reduction in engine operating efficiency.

Changes in the ambient conditions may have a significant impact on the NOx emissions, and in particular the ability to maintain the NOx emissions at a desired level. For example, as the specific humidity increases in the air within the intake manifold, the higher water content in the intake air reduces the peak combustion temperature, and therefore reduces the NOx formation. In addition, the higher specific humidity means there is less oxygen in the cylinder during combustion, and therefore less oxygen exhausted from the cylinder. Both of these issues lead to a reduced oxygen content in the exhaust stream of the engine. Without accounting for the changes in the ambient conditions, the reduced oxygen content may be misinterpreted by a control algorithm which may either unnecessarily adjust the air fuel ratio, or adjust the air fuel ratio in the wrong manner, causing decreased performance in the engine.

Some systems calculate a specific humidity, and use the specific humidity to modify the determined lean limit of the engine. However, operating the engine at a lean limit, and modifying the lean limit to account for changes in the specific humidity does not address the problem of operating an engine in a manner to maintain a desired emissions level despite changes in the ambient conditions, such as specific humidity and/or exhaust pressure.

The present invention is directed to overcoming one or more of the problems set forth above.

SUMMARY OF THE INVENTION

In one aspect of the present invention, a method of maintaining a desired emissions level of an engine having an intake manifold and an exhaust manifold, and an exhaust stack is disclosed. The method includes the steps of establishing a desired emissions level, establishing an engine speed, establishing an engine load, establishing at least one characteristic of one of an intake air and an exhaust gas, and determining a fuel command in response to the engine speed, the engine load, and the desired emissions level, the fuel command resulting in the engine maintaining the desired emissions level.

DETAILED DESCRIPTION

Figure 1:
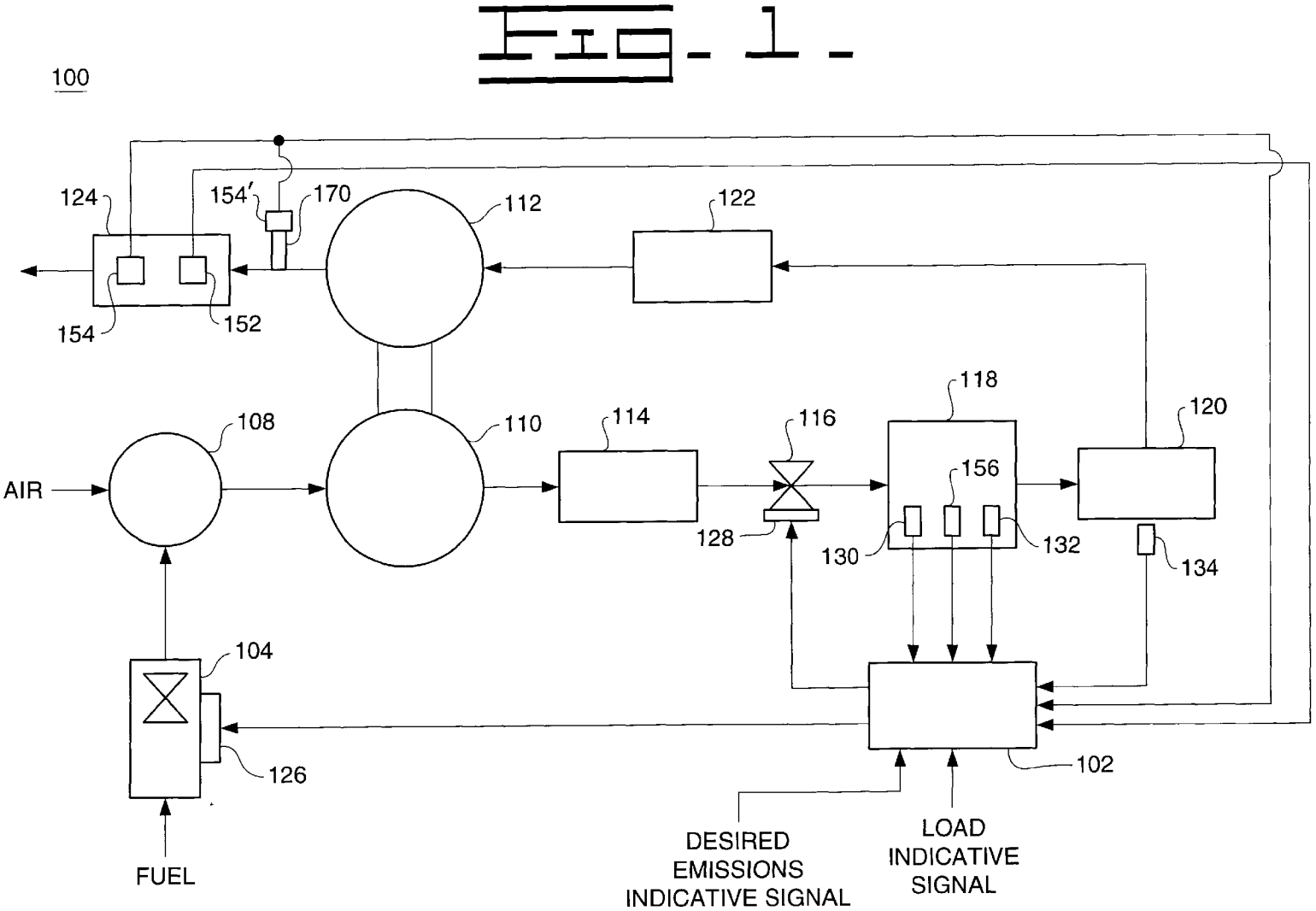
FIG. 1 is an illustration of one embodiment of a fuel system.

The present invention provides a method and apparatus of maintaining a desired emissions level for an engine. FIG. 1 is an illustration of one embodiment of a fuel system 100 of an engine incorporating the present invention. A fuel control valve 104, such as a TechJet™, enables fuel to flow to an air/fuel mixer 108. The air/fuel mixture passes through a compressor 110 and after cooler 114. A throttle 116 controls the volume of air/fuel mixture that flows into an intake manifold 118. The manifold 118 delivers the fuel to one or more cylinders 120. The exhaust from the cylinders 120 passes through an exhaust manifold 122, a turbine 112, and an exhaust stack 124.

A specific humidity sensor 130 may be located in the intake air stream. In one embodiment, the specific humidity sensor 130 is located in the inlet air before the turbo compressor 110. Alternatively the specific humidity sensor 130 may be located in the intake manifold 118. The specific humidity sensor 130 measures the specific humidity of the intake air within the manifold, and responsively delivers a corresponding specific humidity signal to the controller 102.

An oxygen sensing device 152, may be located in the exhaust stream of the engine. The oxygen sensing device 152 senses the gases being exhausted from the engine, i.e., one or more cylinders of the engine, and responsively generates a signal indicative of the oxygen content of the exhaust gases, to the controller 102. In one embodiment, the oxygen sensing device 152 is located in the exhaust manifold 122. Alternatively the oxygen sensing device 152 is located in the exhaust stack 124. In one embodiment, the oxygen sensing device 152 may be an automotive-type, heated sensor such as NTK TL6312. Some oxygen sensing devices such as NTK TL6312 may be sensitive to the pressure they are exposed to. Other types of oxygen sensing devices 152, such as an electrochemical cell type oxygen sensor are less sensitive to pressure, or not sensitive to pressure at all.

A pressure sensing device 154, may be used to sense the pressure located in the exhaust stream of the engine. In one embodiment, the pressure sensing device 154 is located adjacent to the oxygen sensing device 152 and delivers a pressure signal to the controller 102 indicative of the pressure experienced by the oxygen sensing device 152. The pressure sensing device 154 and the oxygen sensing device 152 may be located in the exhaust stack 124 of the engine. In one embodiment, the pressure sensing device 154 is an exhaust pressure sensor. Alternatively, the pressure sensing device may be located in a pipe 170. The pipe 170 is connected to the exhaust stream such that one end is open to the exhaust stream of the engine, and the other end of the pipe 170 is open to the ambient air. In this manner, the sensing device 154 (illustrated as 154' in this alternative location of FIG. 1) may sense the pressure of the exhaust stream without being directly exposed to the extreme temperature of the exhaust gases. In an alternative embodiment, the sensing device 154 may be configured to sense the atmospheric pressure as opposed to the exhaust pressure. In this embodiment, the sensing device 154 may be an ambient air pressure sensor. As will be discussed, the exhaust pressure or ambient air pressure may then be used to account for changes in the ambient conditions with respect to fuel calculations.

In one embodiment, a pressure sensing device 156 may be configured to sense the pressure in the intake manifold 118, an deliver a signal indicative of the intake air pressure to the controller 102.

In one embodiment, a temperature sensing device 132 is located in the intake manifold 118. The temperature sensing device 132 is configured to deliver a temperature signal to the controller 102 indicative of the temperature of the air in the intake manifold 112.

An engine speed sensing device 134 is electrically connected to the controller 102. The speed sensing device 132 can be any type of sensor that produces an electrical signal indicative of engine speed. For example, in one embodiment, the speed sensor 132 is mounted on an engine flywheel housing (not shown) and produces a digital speed signal in response to the speed of the flywheel mounted on an engine crankshaft (not shown). Alternatively, the speed sensing device 132 may be an in-cylinder sensing device configured to deliver a signal to the controller 102 indicative of the speed of the engine.

The controller 102 receives inputs from the oxygen sensing device 152, speed sensing device 134, and one or more of the pressure sensing device 154, a temperature sensing device 132, and a humidity sensor 130. The controller 102 may receive continuous updates from the sensors. The controller 102 determines a throttle position and a fuel control valve position in response to the input signals, and sends the appropriate commands to a throttle actuator 124, and a fuel actuator 126 respectively. That is, one or more software algorithms executing on the controller 102 receive the input signals, and responsively determine the appropriate throttle and fuel commands in order to maintain the desired emissions level, and generate the corresponding command signals.

The controller 102 delivers the throttle command to a throttle actuator 128. The throttle actuator 128 will control the position of the throttle 116 in response to the throttle command.

The controller 102 also delivers a fuel command to a fuel valve actuator 126. The fuel valve actuator 126 will control the position of the fuel control valve 104 in response to the fuel command.

Figure 2:
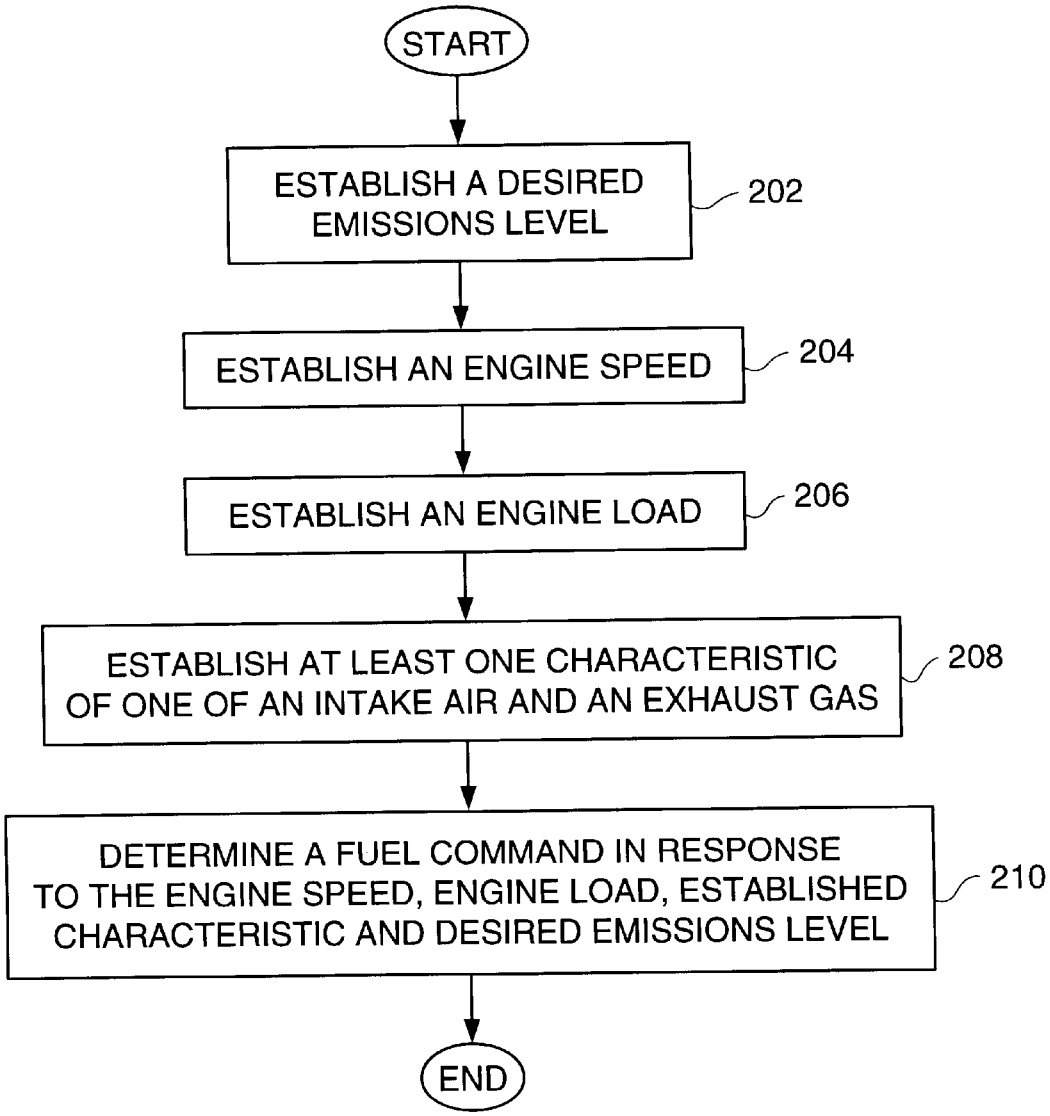
FIG. 2 is an illustration of one embodiment of a method of maintaining a desired emissions level.

FIG. 2 illustrates the one embodiment of the method of the present invention. The present invention includes a method of maintaining a desired emissions level of an engine having an intake manifold 118 and an exhaust manifold 122 and an exhaust stack 124. The method includes the steps of establishing a desired emissions level, establishing an engine speed, establishing an engine load, establishing at least one characteristic of one of an intake air and an exhaust gas, determining a fuel command in response to the engine speed, the engine load, the desired emissions level, and the at least one established characteristic.

In a first control block 202, a desired emissions level is established. In one embodiment, the desired emissions level is a desired NOx level emitted by the engine. The desired NOx level may be established based upon local emissions regulations or site specific emissions regulations. For example, there may be applications, such as operation within a greenhouse, which require the emissions to be lower than specified in local emissions regulations. The desired emissions level may include a range. For example, the desired emissions level may include a designated value, plus or minus five percent of the designated value. Therefore, in one embodiment, maintaining the desired emissions level includes maintaining the actual emissions level within a desired emissions range. Alternatively the desired emissions level may include the designated value plus or minus a second designated value. In one embodiment, the operator may deliver a parameter indicative of the desired emissions level into the controller 102, as will be described.

In one embodiment, once a desired emissions level has been established, an operator may determine a desired rated oxygen to be exhausted by the engine in order to achieve the desired emissions level. The desired rated oxygen is a parameter used to determine the fuel command, as will be explained. The desired rated oxygen may be determined in response to an actual and the desired NOx level. For example, during initial configuration, a desired rated oxygen level may be established based upon a look up table or map which correlates desired rated oxygen as a function of desired NOx level, and actual NOx level, in order to achieve the desired emissions level. The maps or look up tables may be empirically determined. In an alternative embodiment, the desired rated oxygen may be established based upon calculations including the desired and actual NOx levels. Then, if the actual NOx emitted by the engine is greater than the desired NOx, the desired rated oxygen parameter may be adjusted in a manner to effect a change in the fuel command such that the actual NOx emissions change until within a threshold of the desired NOx emissions. For example, an operator may determine an actual NOx emissions through the use of a sensing device, such as a NOx analyzer. The actual NOx emissions may be compared to the desired NOx emissions. A desired rated oxygen to be exhausted by the engine may be determined in response to the comparison. For example, the NOx emissions error may be used to modify the previous value of desired rated oxygen to determine upcoming fuel command.

Therefore, in one embodiment, the operator may input a parameter indicative of the desired rated oxygen to the controller 102, in response to the actual and desired NOx levels. That is, the operator may input a parameter indicative of the desired emissions level into the controller 102, such as the desired rated oxygen level. The desired rated oxygen may be established in response to an operator input into the controller 102. The operator input may be used to modify the desired rated oxygen exhausted by the engine until the actual NOx emissions is equivalent, or within a threshold, or range, of the desired NOx emissions. The desired rated oxygen is then used to determine a fuel command, as is described below. The fuel command is delivered to the system, in one embodiment, and the actual NOx emissions are again compared to the desired NOx emissions. A modification to the desired rated oxygen is made in response to the comparison if necessary, and the process is repeated. Otherwise, if the actual NOx emissions is equal to, or within a threshold of the desired NOx emissions, then the desired rated oxygen is left unmodified. In one embodiment, the desire rated oxygen is determined while the engine is operating at rated load, e.g., full load. In one embodiment, the establishment of the desired emissions level, and corresponding desired rated oxygen level may be considered an initialization step for the engine. The initialization step may be performed periodically, every time the engine is started, or at some other desired interval.

The desired rated oxygen level, as discussed, is a value which may be dynamically established based upon an operator input. For example, when an operator starts an engine, the operator may input a value indicative of the desired rated oxygen to be emitted by the engine, which will be received and stored by the controller 102. The desired rated oxygen level, or value indicative thereof, may then be used by the controller 102 for future operations until the value is changed by an operator. In one embodiment, the desired rated oxygen level may be input by the operator via an operator input device, such as a keypad (not shown), touch screen display (not shown), or other analogous input device. In one embodiment, the desired rated oxygen level may be input by a service technician using a service tool (not shown) which may access the controller 102. In another embodiment, the operator input device may include a receiving device (not shown). For example, the desired rated oxygen level may be received by a receiving device (not shown), from a remote location. A central office may be in communication with a remotely located engine, via satellite or wireless communication techniques, and send the desired oxygen level to the controller 102.

In an alternative embodiment, the desired emissions level may be considered to include, or be the desired oxygen level. In this embodiment, the desired rated oxygen level may be input to the controller associated with the engine as indicated above.

In an alternative embodiment, the desired emissions level, e.g., desired NOx level, may be delivered to the controller 102, and the desired rated oxygen exhausted by the engine may be determined in response to the desired emissions level. The desired emissions level may be delivered to the controller via an operator input device as described above. The desired rated oxygen exhausted may be determined from a map which has been empirically established which indicates desired rated oxygen as a function of desired emissions levels. Alternatively, the desired rated oxygen may be determined based on a calculation involving the desired emissions levels. In yet another embodiment, a desired emissions level may be established and delivered to the controller 102 prior to delivery of the engine to the location where the engine is to be used.

In one embodiment, the desired rated oxygen may be a default value that is modified based upon the current operating conditions, e.g., the difference between the desired and actual NOx level.

In a second control block 204 an engine speed is established. In the preferred embodiment, the engine speed is established in response to the speed signal received from the engine speed sensing device 134.

In a third control block 206 an engine load may be established. Engine load is generally the amount of work being performed by the engine at a particular point in time and is generally defined in terms of rated engine load or work capacity. Engine load can be measured by a wide variety of different methods known in the art such as by using the total quantity of fuel delivered, e.g., fuel rate, to the engine for a particular task or work operation as an indicator of engine load. In addition, engine load may be determined in response to a throttle input, manifold boost pressure, exhaust temperature, and or load sensor. Alternatively, or in addition to, a load signal from the generator could be used to determine load In a fourth control block 208 at least one characteristic of one of an intake air and an exhaust gas is established. In one embodiment, the intake air characteristic includes a specific humidity of the air within the intake air stream. For example the characteristic may be the specific humidity of the air in the inlet air before the turbo 110. Alternatively, or in addition to, the characteristic may include a pressure of the air within the exhaust stream of the engine. In one embodiment, the pressure is established in a manner such that the established pressure is indicative of the pressure that the oxygen sensing device 152 is exposed to. In one embodiment, the established characteristics include the air temperature within the intake manifold, the specific humidity as measured within the intake air stream, and the pressure indicative of the pressure the oxygen sensing device 152 is exposed to in the exhaust stack 124, and the oxygen in the exhaust stream sensed by the oxygen sensing device 152. In an alternative embodiment, the ambient air pressure, or the atmospheric air pressure, may be sensed instead of, or in addition to the exhaust pressure.

Figure 3:
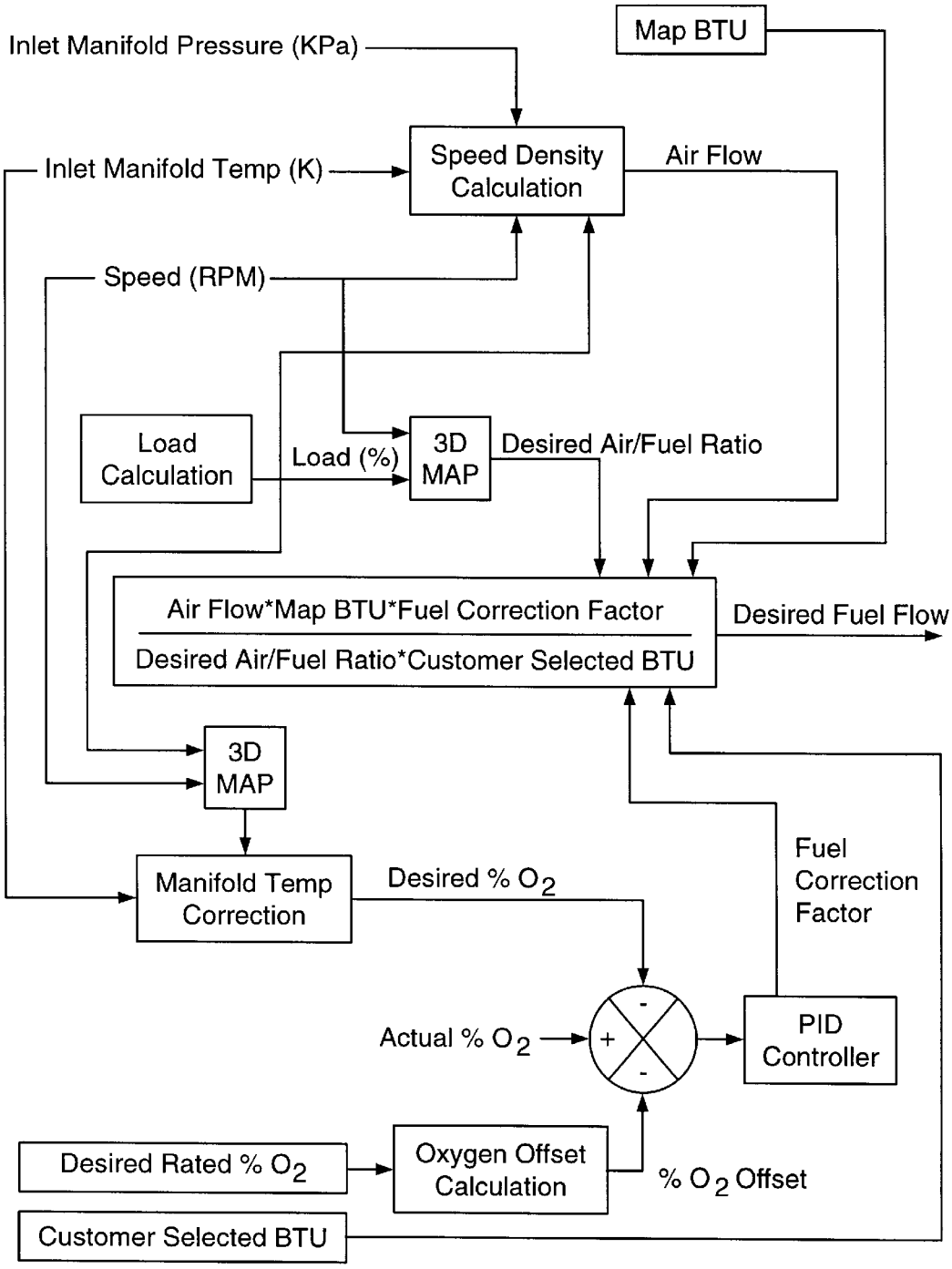
FIG. 3 is a block diagram of one embodiment of a method of maintaining a desired emissions level.
Figure 4A:
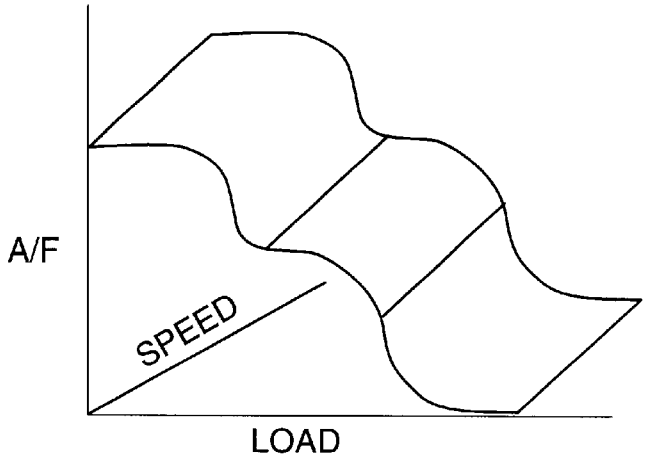
FIG. 4*a* is a map illustrating the desired air/fuel ratio as a function of engine speed and engine load.

In a fifth control block 210 a fuel command is determined in response to the engine speed, engine load, at least one of the established characteristics, and the desired emissions level. In one embodiment, the engine speed, engine load and the desired emissions level are used to determine an air flow, desired air/fuel ratio, and a fuel correction factor. The desired fuel flow is then determined in response to the air flow, desired air/fuel ratio, and the fuel correction factor, as illustrated in FIG. 3. For example, the desired air/fuel ratio is determined in response to the current engine speed and the current engine load. In one embodiment, a three dimensional map, or look up table, may be established through empirical analysis, which maps the desired air/fuel ratio as a function of engine speed and engine load, as illustrated in FIG. 4*a*. The desired air/fuel ratio is then determined through the use of the desired air/fuel map.

The air flow may be determined in response to a sensed inlet manifold pressure, a sensed inlet manifold temperature, the engine speed, and the engine load. For example, in one embodiment, a volumetric efficiency may be determined in response to the engine load and engine speed. The air flow may be calculated based on the inlet manifold air pressure, engine speed, volumetric efficiency and inlet manifold air temperature. One or more of these determinations may be based upon a map or look-up table. For example, a map may be used to determine the volumetric efficiency as a function of engine speed and engine load. The map may be empirically determined and stored in the controller.

A fuel correction factor may be determined in response to the desired rated oxygen exhausted by the engine, a desired oxygen to be exhausted by the engine, and the actual oxygen exhausted by the engine. As illustrated in FIG. 3, a rated oxygen offset may be determined based upon the desired rated oxygen exhausted from the engine. For example, the desired rated oxygen exhausted by the engine may be compared to a map rated oxygen exhausted by the engine.

The map rated oxygen exhausted by the system may be established at particular ambient conditions, and while the engine is operating at rated load. The desired rated oxygen may be established at rated load. In one embodiment, rated load is equivalent to maximum load. Therefore, the desired rated oxygen indicates the desired oxygen at rated load, e.g., full load. The difference between the desired rated oxygen and the map rated oxygen levels is that the ambient conditions may have changed. Therefore, in one embodiment, an offset is determined by subtracting the map rated oxygen from the desired rated oxygen to reflect the potential difference in ambient conditions.

Figure 4B:
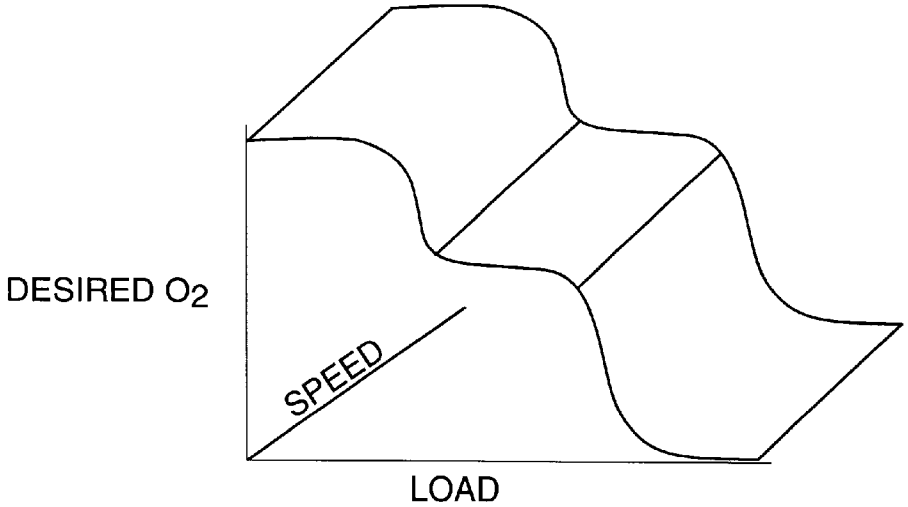
FIG. 4*b* is a map illustrating desired oxygen as a function of engine speed and engine load.
Figure 5:
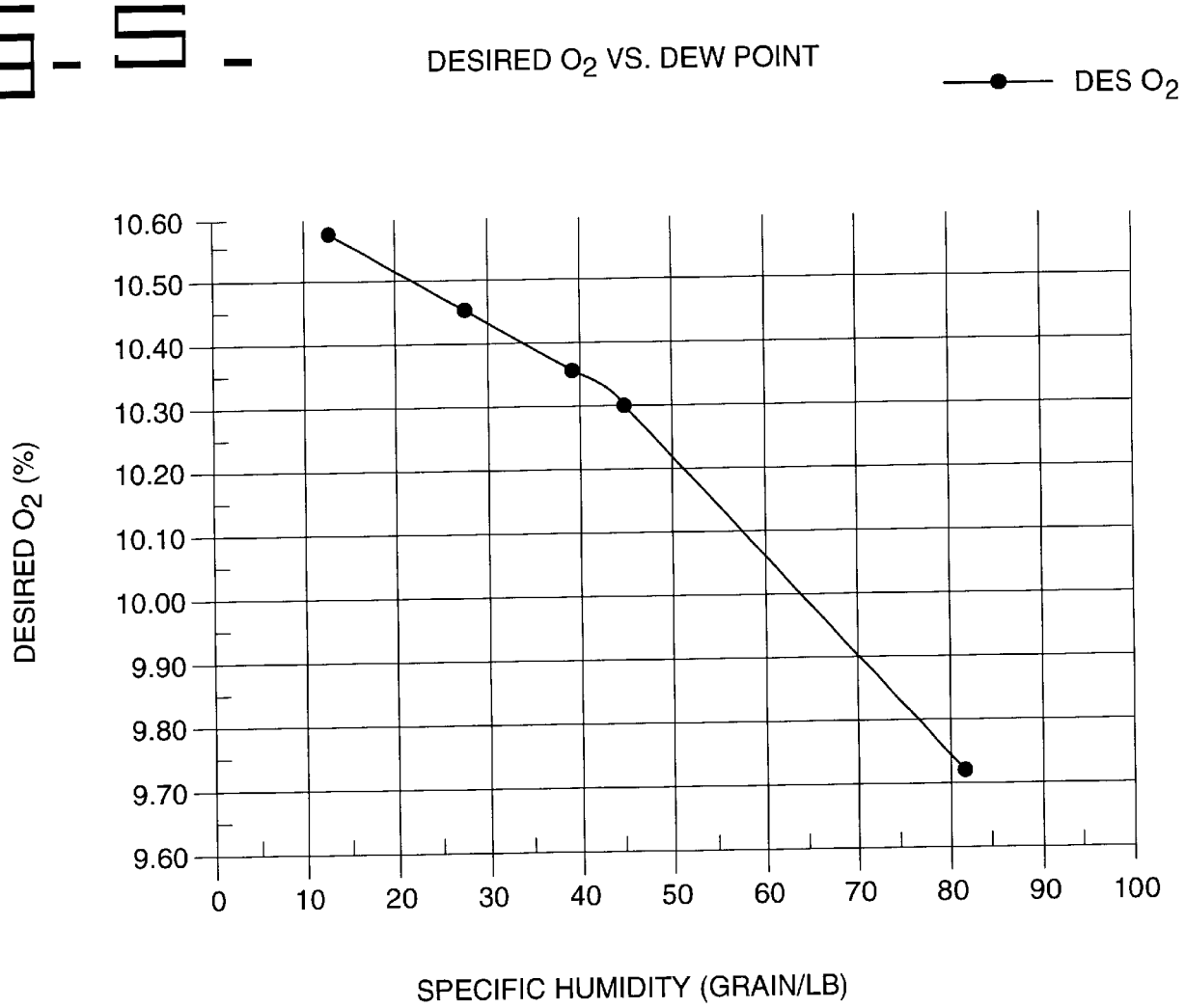
FIG. 5 is an illustration of the relationship between specific humidity and desired oxygen.

In the preferred embodiment, a desired, or predicted, oxygen level exhausted may be determined. That is, for the combustion that is about to occur in response to the initial fuel command, the desired oxygen output may be determined. In the preferred embodiment, a three dimensional map, or look up table, may be established through empirical analysis, which maps desired oxygen output as a function of current engine speed and current engine load, as illustrated in FIG. 4*b*. The oxygen being exhausted by the engine, is indicative of the amount of NOx being exhausted by the engine. The desired rated oxygen, as mentioned, indicates the desired rated oxygen at rated load, e.g., full load. The desired oxygen determined based on the map illustrated in FIG. 4*b* is based upon the current engine speed and engine load, which may be different from the rated load at which the desired rated oxygen was determined. By compensating the fuel calculations in response to the desired oxygen, and the desired rated oxygen, the desired NOx emissions level may be maintained. The desired oxygen exhausted may be determined as a function of the current engine speed and current engine load. In one embodiment, the desired, or predicted oxygen level, is compensated in response to one or both of the specific humidity measurement and the established exhaust pressure. The combustion process that occurs within a cylinder is affected by the specific humidity of the air that flows into the cylinder. For example, the higher the specific humidity of the intake air, the lower the amount of oxygen that is available in the intake cylinder during combustion, and therefore, the lower the exhausted oxygen amount will be. In addition, the higher the specific humidity of the intake air, the lower the temperature of the combustion process, due in part to the fact that more energy will be expended heating the additional water in the air. As a result, the combustion temperature is lower, and therefore the NOx emissions are lower. The lower NOx emissions further reduces the amount of oxygen exhausted from the cylinder. Therefore, as the specific humidity increases, the predicted, or desired, level of oxygen in the exhaust gases is reduced, as illustrated in FIG. 5. Therefore, to account for the particular specific humidity, a compensation factor may be determined which accounts for both the change in the temperature of the combustion process due to the specific humidity, which leads to a change in the amount of oxygen exhausted, and the change in the amount of oxygen that entered the cylinder based upon the specific humidity, which also changed the amount of oxygen exhausted. For example, the higher the specific humidity of the intake air, the cooler the combustion, and the lower the NOx emissions will be. Therefore, as the specific humidity increases, the desired level of oxygen in the exhaust gases may be reduced to maintain a NOx emissions level, as illustrated in FIG. 5. Therefore, to account for the particular specific humidity, a compensation factor may be determined which accounts for the change in the oxygen required to maintain the desired NOx. Again, maintaining the desired NOx level may include maintaining the actual NOx level within a desired range, or threshold, of the desired NOx level. Additionally, the oxygen sensor 152 may be sensitive to pressure changes in the exhaust. The effects of this sensitivity may also included in the compensation factor.

Figure 6:
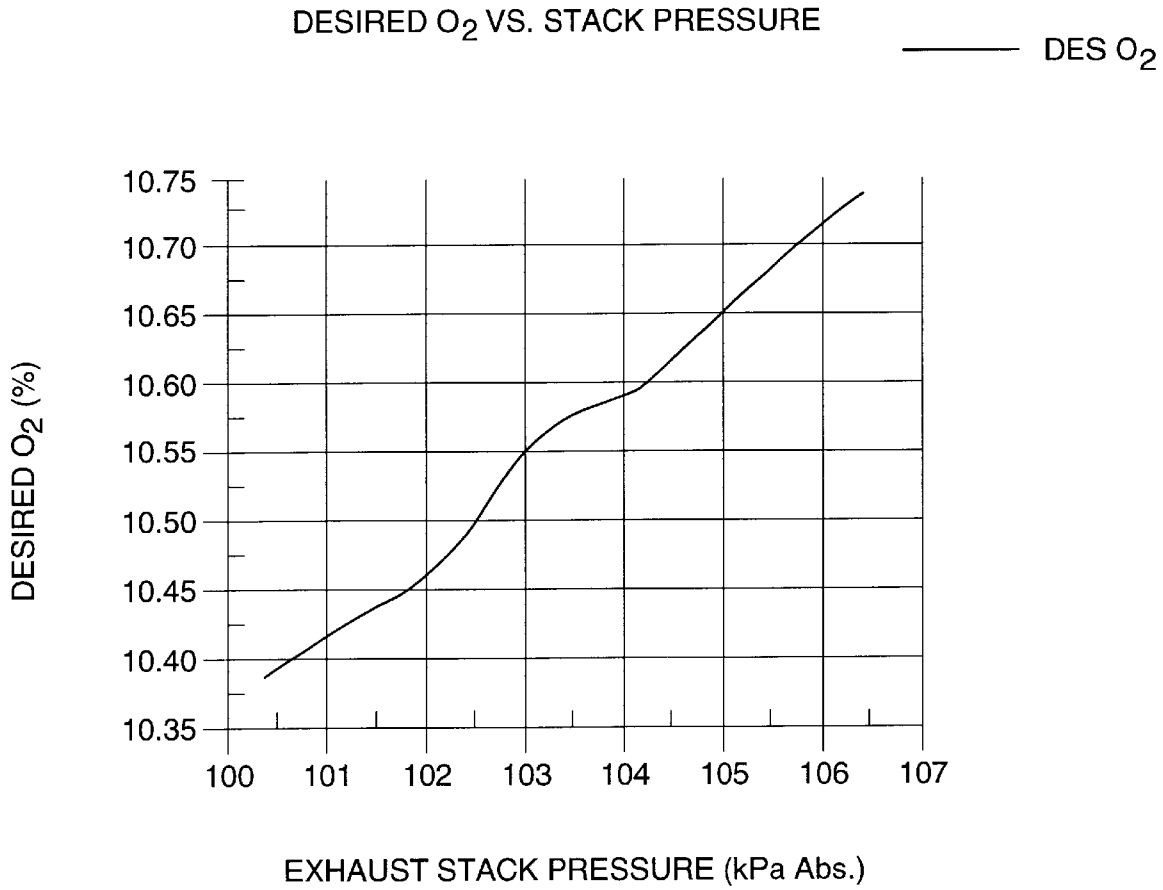
FIG. 6 is an illustration of the relationship between exhaust stack pressure and desired oxygen.

In one embodiment, the use of pressure compensation may be dependent on the type of oxygen sensing device 152 used. Some types of oxygen sensors 152 are sensitive to changes in the pressure of the exhaust stack. Therefore a pressure sensing device 154 may be located adjacent to the oxygen sensing device 152 to establish the pressure experienced by the oxygen sensing device 152. In one embodiment, depending upon the pressure sensing device used, pressure within the exhaust stack affects the desired oxygen output level in a manner as illustrated in FIG. 6. Therefore, the predicted oxygen output may be modified to account for changes in the intake air temperature, the specific humidity of the intake air, and the exhaust pressure the oxygen sensing device is exposed to. In one embodiment, the ambient air pressure may be compensated for instead of, or in addition to the exhaust pressure. Each of these compensation factors (associated with the intake air temperature, the specific humidity of the intake air, and the exhaust pressure the oxygen sensing device) may be empirically determined and stored in a map or look up table. For example, a pressure compensation factor may be empirically determined as a function of the pressure which the oxygen sensing device is exposed to, and stored in a map or look up table, and used to compensate the desired or predicted oxygen level emitted. Alternatively, a pressure compensation factor may be determined dynamically using a formula. For example, a pressure compensation factor may be set equal to (X*Absolute Stack Pressure(KPa)). Where X is a constant. Additional variables or offsets may be used to determine the pressure compensation factor. The value for X or any other variables or offsets are implementation dependent and may vary from one engine type to another. A specific humidity compensation factor may be empirically determined as a function of the specific humidity of the air within the intake manifold, and stored in a map or look up table. In an alternative embodiment, a specific humidity compensation may be dynamically determined using a formula. For example, the specific humidity compensation factor=(Y*specific humidity (gr/lbm dry air)). In one embodiment, Y is an empirically established constant. Alternatively Y could vary as a function of the specific humidity. The value Y or any other variables or offsets is implementation dependent and may vary from one engine type to another.

In addition, a temperature compensation factor may be used to modify the desired oxygen exhausted by the engine in order to account for the temperature of the intake air flowing into the manifold. A temperature compensation factor may be empirically determined as a function of the temperature of the air within the intake manifold.

The fuel correction factor may then be determined in response to the rated oxygen offset, the modified, or compensated, desired oxygen exhausted by the engine, and the actual oxygen as measured by the oxygen sensing device. In one embodiment, the rated oxygen offset and the modified desired oxygen level may be compared to the actual measured oxygen level. For example, the rated oxygen offset, and the modified desired oxygen level may be subtracted from the actual oxygen measurement. In the preferred embodiment, the result is then delivered to a PID controller to determine the fuel correction factor. One example, of such a PID controller is:

FCF=(Kp*ei)+(Ki*iei)+(KD*deltaei)

Where

FCF=the fuel correction factor ei=error(desired oxygen−actual oxygen)

KP=Proportional gain of the governor

KI=Integral gain of the governor

KD=Derivative gain of the governor deltaei=the rate of change of the error iei=an integral factor.

In the preferred embodiment, the air flow, is then multiplied by the fuel correction factor and a map BTU, and the result divided by the desired air/fuel ratio multiplied by a customer selected BTU to determine the desired fuel flow to the cylinder, as illustrated below:

$$\text{Fuel Command} = (\text{Air Flow} * \text{Map } BTU * \text{Fuel Correction Factor}) / (\text{Desired Air Fuel Ratio} * \text{Operator} - \text{selected } BTU \text{ value})$$

Where:

Map BTU is the heating value of the fuel that was used when the Air Fuel ratio map was created and Operator-selected BTU value is a heating value of the fuel that is currently being used. For example, an operator may input a BTU value indicative of the fuel being used, via an operator input device as described earlier.

A fuel command is then determined in response to the desired fuel flow, in order to deliver the desired fuel to the cylinder.

INDUSTRIAL APPLICABILITY

The present invention includes a method and apparatus of maintaining a desired emissions level of an engine having an intake manifold and an exhaust manifold, and an exhaust stack. The method includes the steps of establishing a desired emissions level, establishing an engine speed, establishing an engine load, establishing at least one characteristic of one of an intake air and an exhaust gas, and determining a fuel command in response to the engine speed, the engine load, the desired emissions level, and the established characteristics.

In one embodiment, an operator establishes a desired emissions level, such as a desired NOx level, based on either a local regulation or a site specific requirement. An initialization procedure may be performed whereby the operator runs the engine at a rated load, such as full load. The operator then monitors the actual engine emissions level and compares it to the desired emissions level. The difference between the actual and desired emissions level is used to determine a parameter, such as a desired rated oxygen level, which is then input to the controller associated with the engine. The desired rated oxygen level is used by a software algorithm running on the controller to determine a fuel command. The algorithm is configured to determine a fuel command in a manner such that the desired emissions level is maintained. Therefore, during the initialization procedure, the resulting actual emissions may be compared to the desired emissions level, and the desired rated oxygen level is modified accordingly until the actual emissions level is equal to, or within an acceptable range of the desired emissions levels.

Figure 7A:
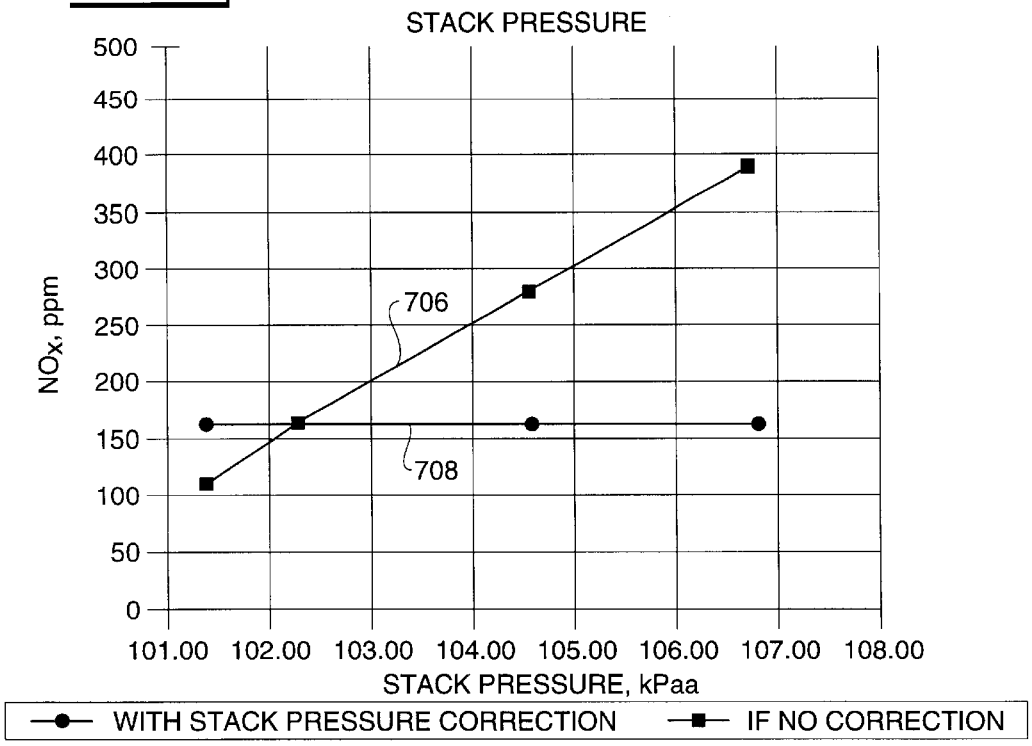
FIG. 7*a* is an illustration of the impact of changes in the specific humidity on the actual emissions level.
Figure 7B:
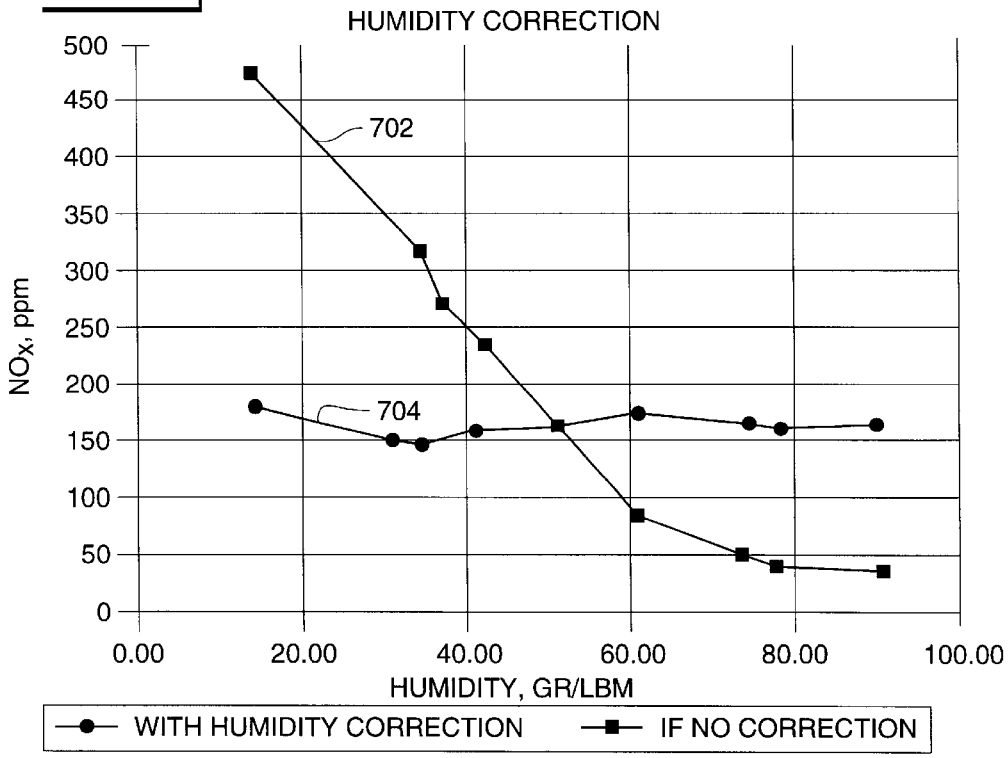
FIG. 7*b* is an illustration of the impact of changes in the exhaust pressure on the actual emissions level.

The software algorithm executing on the controller is configured to account for changes in ambient conditions. Therefore, the specific humidity, exhaust pressure, and/or ambient air pressure may be measured and used to compensate, or modify, a desired oxygen output level. The modified, desired oxygen output level may be compared with the actual oxygen output level in the exhaust gases, and the result used to determine a fuel correction factor. The fuel correction factor is used to determine the fuel command. In this manner, algorithm compensates the fuel command based on changes in the ambient conditions, such as the specific humidity, the exhaust pressure, or the ambient air pressure. Therefore, the desired emissions levels may be maintained despite variations in ambient conditions. For example, the emissions levels may be maintained within a range or threshold of the desired emissions level, i.e., the desired emissions level includes a range or threshold value within which the actual emissions are desirably maintained. FIG. 7A illustrates test results using this invention during changes in the specific humidity. The plot 702 illustrates the actual emissions level without using the present invention, as compared to plot 704 where one embodiment of the present invention was utilized. Using one embodiment of the present invention, as the specific humidity varies, the desired emissions level was maintained. In particular, the actual emissions level was maintained within an acceptable threshold of the desired emissions level. FIG. 7B illustrates test results using this invention during changes in the exhaust pressure. The plot 706 illustrates the actual emissions level without using the present invention, as compared to plot 708 where one embodiment of the present invention was utilized. Using one embodiment of the present invention, as the exhaust pressure varies, the desired emissions level was maintained. In particular, the actual emissions level was maintained within an acceptable threshold, or range, of the desired emissions level.

Other aspects, objects, and advantages of the present invention can be obtained from a study of the drawings, the disclosure, and the claims.

What is claimed is:

1. A method of maintaining a desired emissions level of an engine having an intake manifold and an exhaust manifold, and an exhaust stack, comprising:

establishing a desired emissions level;

establishing an engine speed;

establishing an engine load;

establishing a pressure of an exhaust gas;

establishing a temperature of an intake air;

establishing a humidity of an intake air; determining a fuel command in response to said engine speed, said engine load, said desired emissions level, and said temperature, and said humidity of the intake air and said pressure of said exhaust gas, said fuel command resulting in the engine maintaining the desired emissions level.

2. A method, as set forth in claim 1, wherein said desired emissions level comprises a desired NOx output level.

3. A method, as set forth in claim 1, wherein said desired emissions level comprises a desired rated oxygen level.

4. A method, as set forth in claim 3, wherein establishing said humidity comprises measuring a specific humidity of air within the intake manifold.

5. A method, as set forth in claim 1, further comprising determining a desired oxygen level in said exhaust manifold in response to said desired emissions level.

6. A method, as set forth in claim 5, wherein the step of determining said fuel command, comprises:

modifying said desired oxygen level in response to said established temperature, said measured specific humidity, and said established stack pressure;

establishing an actual oxygen level in said exhaust manifold;

comparing said actual oxygen level with said modified desired oxygen level; and modifying said fuel command in response to said comparison.

7. A method, as set forth in claim 1, wherein said desired emissions level includes a desired emissions level range.

8. A method of maintaining a desired emissions level of an engine having an intake manifold and an exhaust manifold, and an exhaust stack, comprising the steps of:

establishing a desired emissions level;

establishing a desired rated oxygen exhaust level in response to said desired emissions level;

establishing an engine speed;

establishing an engine load;

establishing an intake manifold temperature;

establishing a stack pressure;

determining a fuel command in response to said desired rated oxygen exhaust level, said engine speed, said engine load, said intake manifold temperature, and said stack pressure; thereby maintaining the desired emissions level.

9. A method, as set forth in claim 8, further comprising the step of measuring a specific humidity of the intake air; wherein said fuel command is determined in response to said desired rated oxygen exhaust level, said engine speed, said engine load, said intake manifold temperature, said stack pressure, and said measured specific humidity.

10. A method, as set forth in claim 9, further comprising the steps of:

determining a desired oxygen level in response to said engine speed, said engine load, said stack pressure, said manifold temperature, and said specific humidity; and measuring an oxygen exhaust level.

11. A method, as set forth in claim 10, further comprising the step of determining a fuel correction factor in response to said rated oxygen level said desired oxygen level, and said measured oxygen level.

12. A method, as set forth in claim 11, further comprising the steps of:

measuring an intake manifold pressure;

determining an air flow in response to said engine speed, said engine load, said manifold temperature and said intake manifold pressure; and determining a desire air flow in response to said engine speed and said engine load.

13. A method, as set forth in claim 12, wherein determining said fuel command further includes determining said fuel command in response to said fuel correction factor, said desired air/fuel ratio, and said determined air flow.

14. A method, as set forth in claim 8, wherein said desired emissions level includes a desired emissions level range.

15. A method of maintaining a desired emissions level of an engine having an intake manifold and an exhaust manifold, and an exhaust stack, comprising:

establishing a desired emissions level;

establishing a desired rated oxygen exhaust level in response to said desired emissions level;

establishing an engine speed;

establishing an engine load;

establishing an intake manifold temperature;

measuring a specific humidity;

establishing a pressure of the exhaust stack;

determining a fuel command in response to said desired rated oxygen exhaust level, said engine speed, said engine load, said intake manifold temperature, and said stack pressure.

16. An apparatus configured to maintain a desired emissions level for an engine having an intake manifold and an exhaust manifold, and an exhaust stack, comprising:

a speed sensing device configured to sense a speed of the engine and responsively generate a speed signal;

an intake manifold temperature sensing device configured to sense a temperature of the intake manifold and responsively generate a temperature signal;

a pressure sensing device configured to sense a pressure of the exhaust stack and responsively generate a pressure signal;

a controller configured to receive said speed signal, said temperature signal, and said pressure signal, establish a desired rated oxygen level, establish an engine load, and determine a fuel command in response to said desired rated oxygen exhaust level, said engine speed, said engine load, said intake manifold temperature, and said stack pressure.

17. An apparatus, as set forth in claim 16, further comprising:

an oxygen sensing device configured to sense an oxygen level in one of said exhaust manifold and said exhaust stack, and responsively generate an oxygen signal;

an intake manifold pressure sensing device configured to sense a pressure in the intake manifold and responsively generate an intake manifold pressure signal; and wherein said controller is further configured to receive said oxygen signal and said intake manifold signal, determine a desired oxygen level in response to said engine load, said engine speed, said intake manifold temperature, and said stack pressure, and determine said fuel command in response to said engine speed, said engine load, said intake manifold pressure signal said desired rated oxygen level, said desired oxygen level and said oxygen signal.

18. An apparatus, as set forth in claim 17, wherein said controller is further configured to determine an air flow in response to said inlet manifold pressure, said inlet manifold temperature, said engine speed and said engine load, determine a desired air/fuel ratio in response to said engine speed and said engine load, determine a fuel correction factor in response to said desired rated oxygen level, said desired oxygen level, and said oxygen signal, and determine a fuel command in response to said air flow, said desired air/fuel ratio, and said fuel correction factor.

19. An apparatus, as set forth in claim 18, further including a load sensing device configured to generate a signal indicative of an engine load; wherein said controller is further configured to receive said load signal and establish said engine load in response to said load signal.

20. An apparatus, as set forth in claim 19, further comprising an operator input device configured to generate an input signal, wherein said controller is further configured to establish said desired rated oxygen level in response to said input signal.

21. An apparatus, as set forth in claim 19, wherein said input signal is one of a desired emissions level, and a desired rated oxygen level.

22. An apparatus, as set forth in claim 21, further comprising a specific humidity sensor configured to generate a specific humidity signal, wherein said controller is further configured to receive said specific humidity signal and determine said desired oxygen level in response to said engine speed, said engine load, said stack pressure, said intake manifold temperature and said specific humidity signal.

23. An apparatus, as set forth in claim 16, wherein said desired emissions level includes a desired emissions level range.

24. A method of operating an engine, comprising:

determining a humidity of an intake air;

determining a pressure of an exhaust mixture;

determining a temperature of an intake air;

determining an engine speed;

determining an engine load;

determining an oxygen concentration of an exhaust mixture as a function of the humidity of the intake air and pressure of the exhaust mixture; and determining a fuel command for the engine as a function of the oxygen concentration of the exhaust mixture.

25. The method of claim 24 wherein determining the humidity of the intake air comprises determining a relative humidity of the intake air.

26. The method of claim 25, further comprising determining a specific humidity of the intake air as a function of the relative humidity and the pressure of the intake air.

27. The method of claim 24, further comprising determining a pressure of the intake air; and wherein determining the fuel command further comprises determining the fuel command as a function of the pressure of the intake air.

28. A method for operating an engine, comprising:

determining a humidity of an intake air;

determining a pressure of an exhaust mixture; and determining a level of oxygen of an exhaust of the engine as a function of the humidity of the intake air and pressure of the exhaust mixture.

29. The method of claim 28, further comprising:

adjusting an air to fuel ratio of the engine as function of the exhaust gas oxygen concentration as a function of the humidity of the intake air

30. The method of claim 28 wherein determining a level of oxygen comprises determining an oxygen concentration.

31. The method of claim 28 further comprising:

determining a level of oxygen of an exhaust of the engine as a function of the humidity of the intake air and the pressure of the exhaust air; and wherein adjusting an air to fuel ratio comprises adjusting the air to fuel ratio as a function of the level of oxygen in the exhaust of the engine.

32. A method for operating an engine, comprising:

determining a humidity of an intake air;

determining a pressure of an exhaust mixture; and adjusting an air to fuel ratio of the engine as function of the humidity of the intake air and the pressure of the exhaust mixture.

33. The method of claim 32 wherein adjusting the air to fuel ratio comprises adjusting a fuel flow to the engine.

34. The method of claim 32 further comprising adjusting the air to fuel ratio of the engine as a function of the determined air to fuel ratio.

35. The method of claim 32, further comprising:

determining an engine speed;

determining a temperature of the intake air; and wherein adjusting the air to fuel ratio further comprises determining the air to fuel ratio as a function of the engine speed and temperature of the intake air.

* * * * *